US005989050A

United States Patent [19]

Lee

[11] Patent Number: 5,989,050

[45] Date of Patent: Nov. 23, 1999

[54] STRUCTURE OF A CONNECTOR FOR A MICROPHONE

[76] Inventor: Chang-Chi Lee, P.O. Box 82-144, Taipei, Taiwan

[21] Appl. No.: 09/018,792

[22] Filed: Feb. 4, 1998

[51] Int. Cl.[6] ..... H01R 13/627

[52] U.S. Cl. ..... 439/350; 439/352; 439/320

[58] Field of Search ..... 439/320–321, 439/345, 350, 352–357

[56] References Cited

U.S. PATENT DOCUMENTS 4,261,628 4/1981 Gallagher et al. ..... 439/350
4,316,647 2/1982 Bailey et al. ..... 439/354
5,860,824 1/1999 Fan ..... 439/265 X

*Primary Examiner*—Khiem Nguyen
*Attorney, Agent, or Firm*—A & J

[57] ABSTRACT

A connector for a microphone includes a connecting member provided with a hook having a slot, a tubular member having an end formed with a plurality of hooks and fitted on the connecting member, an adjusting ring having a flange engaged with the hooks of the tubular member and an inner side formed with internal threads, and a fixing collar having an end formed with external threads engageable with the internal threads of the adjusting ring and a longitudinal notch engageable with the slot of the connecting member, whereby the microphone can be firmly and easily engaged with the connector.

1 Claim, 4 Drawing Sheets

STRUCTURE OF A CONNECTOR FOR A MICROPHONE

BACKGROUND OF THE INVENTION

1. Field of the Invention

This invention is related to an improvement in the structure of a connector for a microphone.

2. Description of the Prior Art

As shown in FIG. 1, the conventional connector 1 for a microphone 12 is provided with a button 11 adapted to engage with a slot 121 at the bottom of the microphone 12. However, there is a clearance between the connector 1 and the microphone 12 thus causing the microphone to move from side to side and therefore making it very inconvenient to use.

Therefore, it is an object of the present invention to provide an improvement in the structure of a connector for a microphone which can obviate and mitigate the above-mentioned drawbacks.

SUMMARY OF THE INVENTION

This invention is related to an improvement in the structure of a connector for a microphone.

It is the primary object of the present invention to provide an improved connector for a microphone which can be firmly engaged with a microphone.

It is another object of the present invention to provide an improved connector for a microphone which can prevent a microphone from shaking or detaching therefrom accidentally.

It is still another object of the present invention to provide an improved connector for a microphone which is simple in construction.

It is still another object of the present invention to provide an improved connector for a microphone which is low in cost.

It is a further object of the present invention to provide an improved connector for a microphone which is easy to manufacture.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
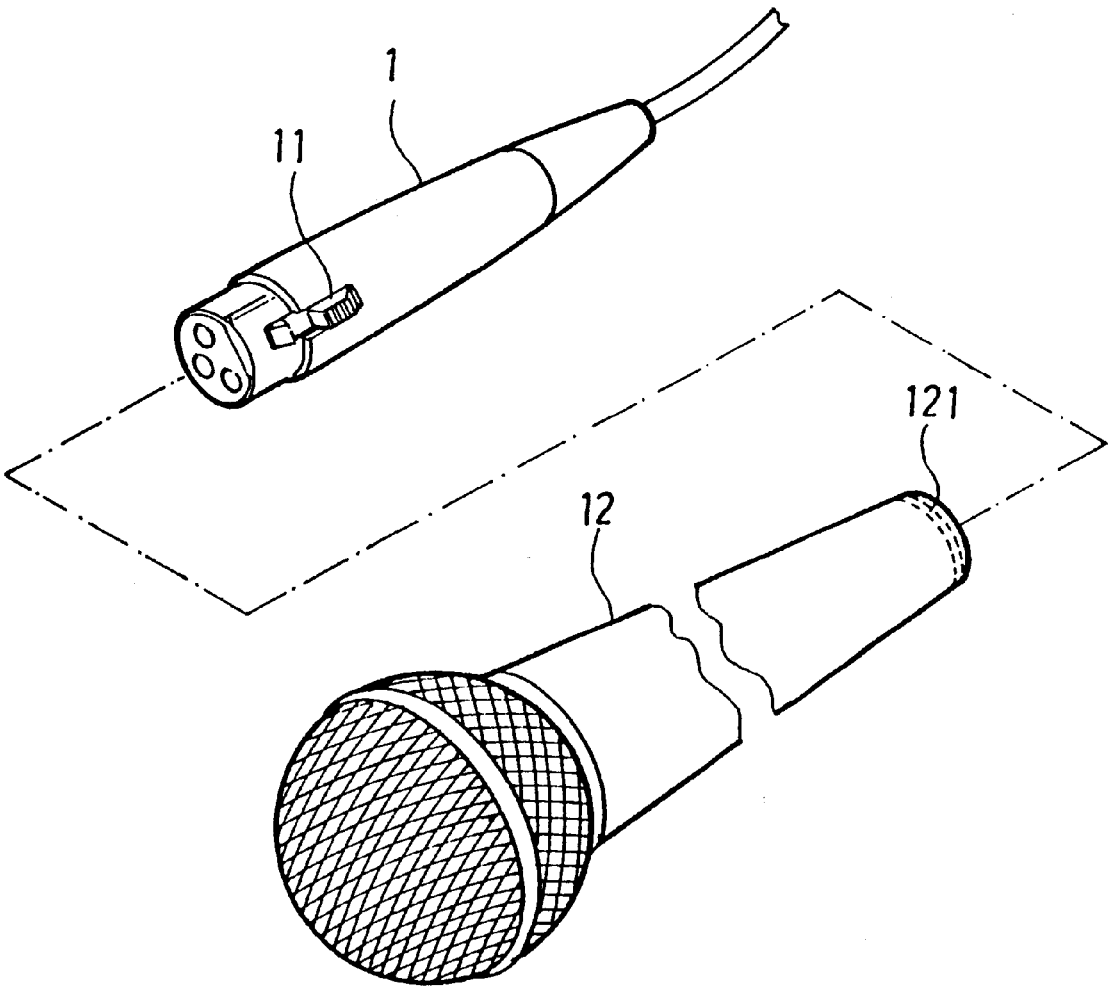
PRIOR ART FIG. 1
FIG. 1 illustrates a prior art microphone connector.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
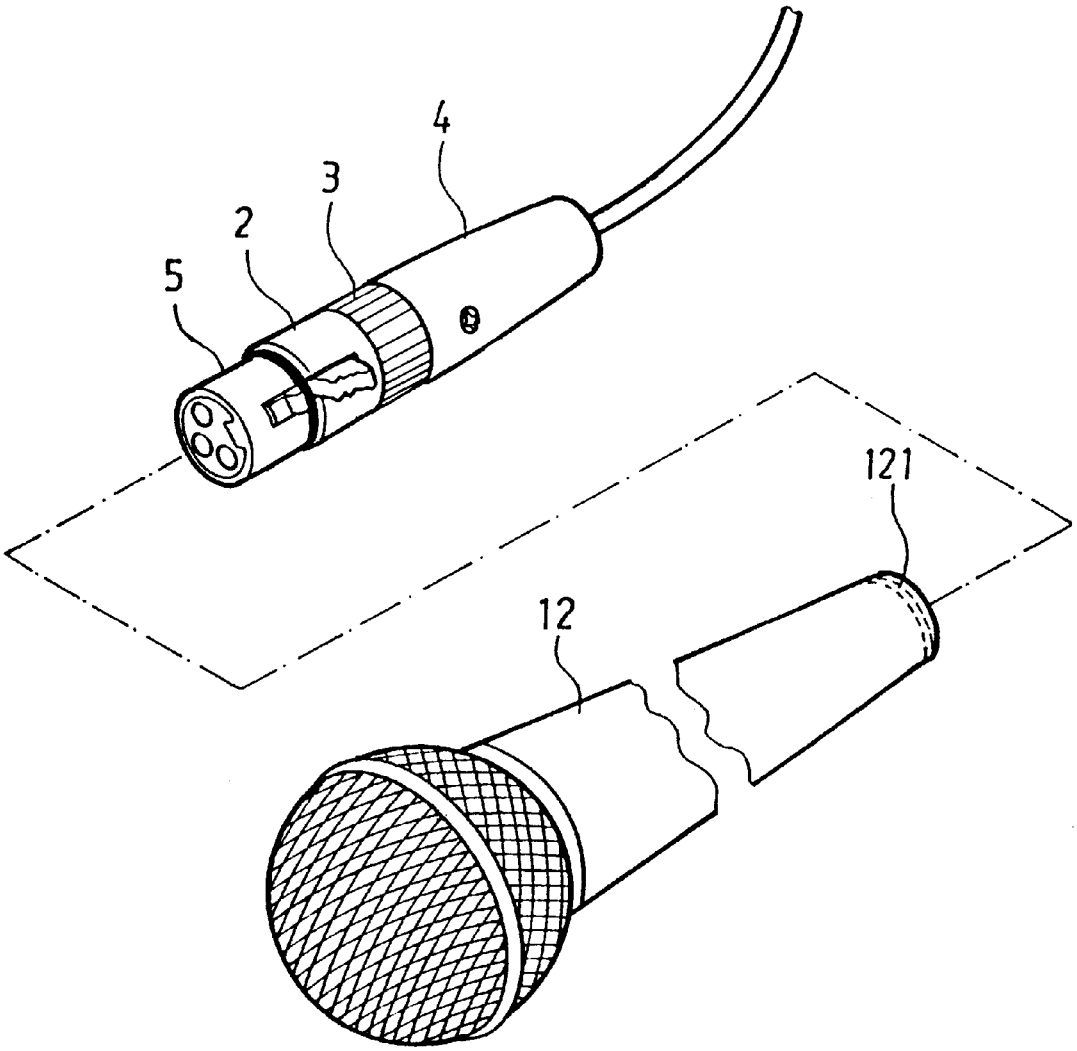
FIG. 2 illustrates a microphone connector according to the present invention.
Figure 3:
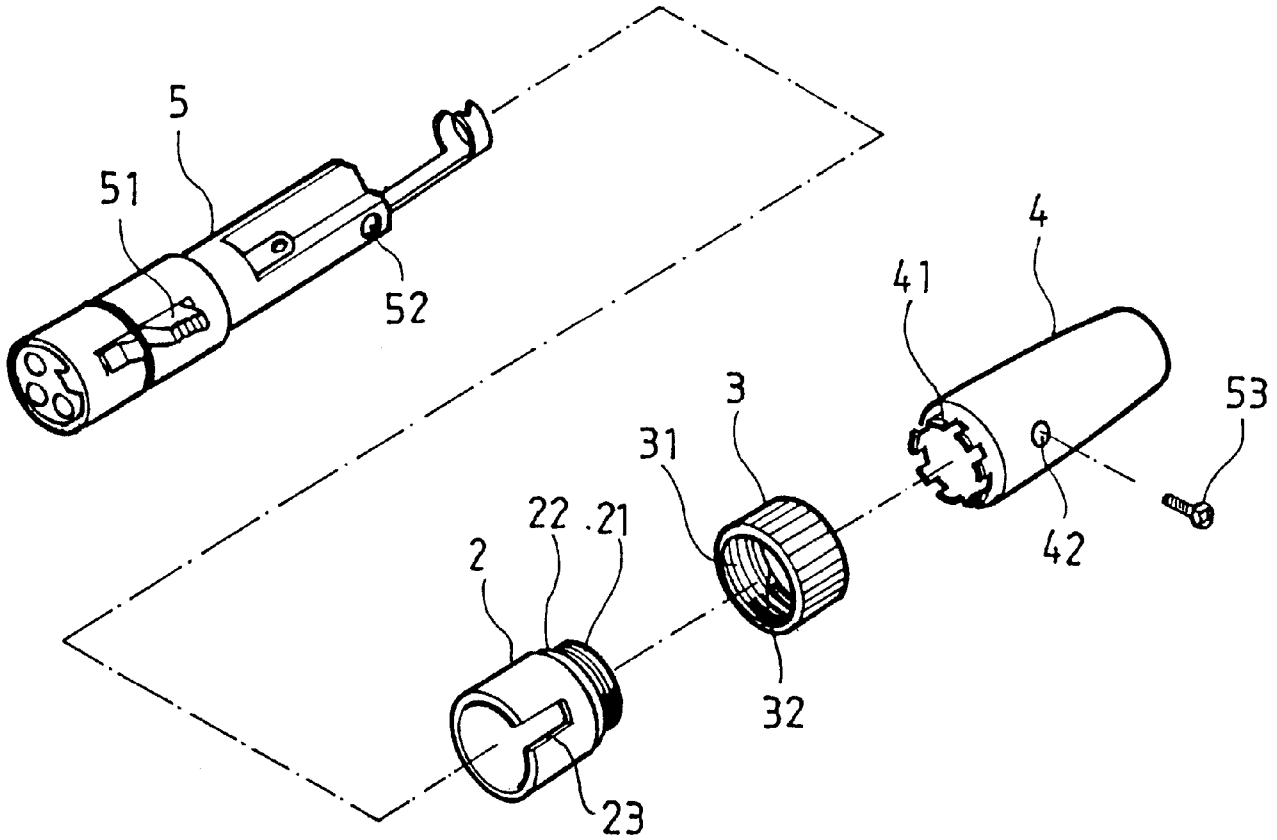
FIG. 3 is an exploded view of the microphone connector according to the present invention.

With reference to the drawings and in particular to FIGS. 2 and 3 thereof, the microphone connector according to the present invention essentially comprises a fixing collar 2, an adjusting ring 3, a tubular member 4, and a connecting member 5. The adjusting ring 3 is formed with a flange 32 at an end and internal threads at its inner side. The front end of the tubular member 4 is formed with a plurality of hooks 41 rotatably engaged with the flange 32 of the adjusting ring 3 so that the adjusting ring 3 can be turned with respect to the tubular member 4. The fixing collar 2 has a conical edge 22 and a threaded portion 21 at an end thereof. The threaded portion 21 of the fixing collar 2 is turned into the adjusting ring 3 with the conical edge 22 bearing against the inner edge of the fixing collar 2.

The connecting member 5 is engaged with the fixing collar 2, the adjusting ring 3 and the tubular member 4 to form a connector. The connecting member 5 is provided with a hook 51 extending out of a notch 23 of the fixing collar 2 so that when the connecting member 5 is fitted in the lower end of a microphone 12, the hook 51 of the connecting member 5 will be engaged with a slot 121 at the bottom of the microphone 12. The connecting member 5 has a threaded hole 52 aligned with a through hole 42 of the tubular member 4 so that a screw 53 is turned therethrough to lock the connecting member 5 on to the tubular member 4. Hence, when the adjusting ring 3 is rotated, the fixing ring 2 will fixing collar 2 will be pushed against the microphone 12 thereby eliminating the clearance between the microphone 12 and the connecting member 5 and therefore preventing the microphone 12 from shaking.

Figure 4:
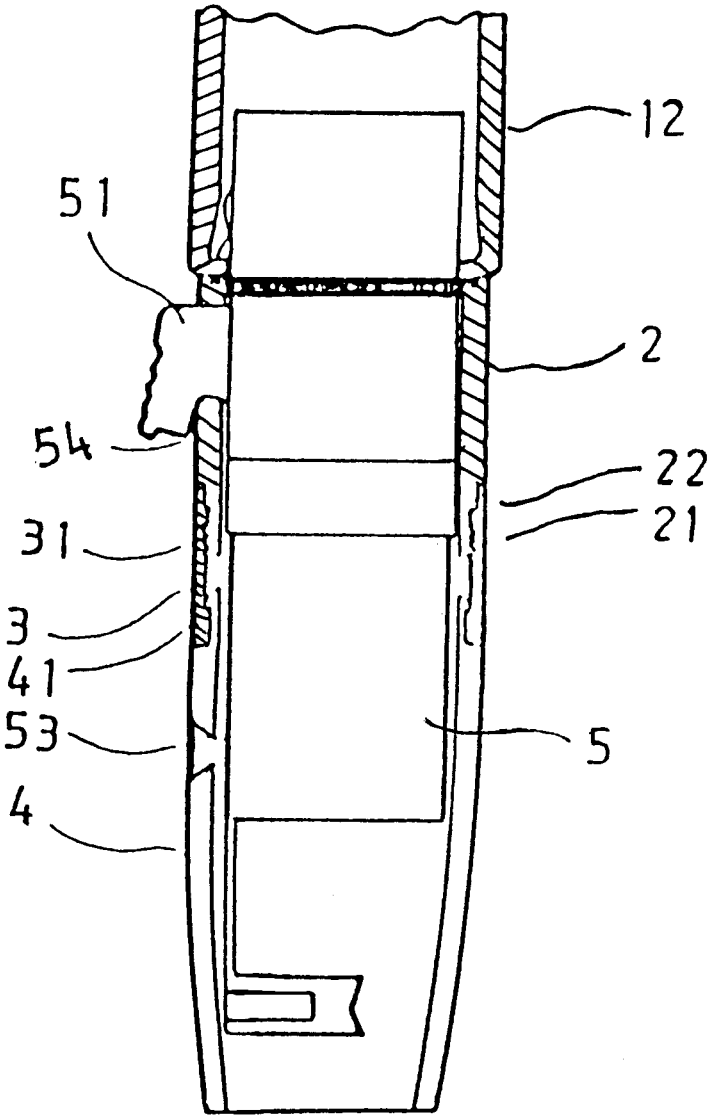
FIG. 4 is a sectional view of the microphone connector according to the present invention.

As shown in FIG. 4, the connecting member 5 is fixedly mounted on the tubular member 4 by a screw 53 and the flange 32 of the adjusting ring 3 is rotatably engaged with the hooks 41 of the tubular member 4 so that when the adjusting ring 3 is turned, the fixing collar 2 will be pushed against the hook 51 of the connecting member 5 thereby engaging the notch 23 of the fixing collar 2 with a slot 54 on the hook 51 of the connecting member 5 and therefore preventing the hook 51 from being depressed. As a consequence, the connector is firmly engaged with the microphone 12 hence preventing the microphone 12 from shaking or detaching from the connector accidentally.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A connector for a microphone comprising:

a connecting member provided with a hook having a slot;

a tubular member having an end formed with a plurality of hooks and fitted on said connecting member;

an adjusting ring having a flange engaged with said hooks of said tubular member and an inner side formed with internal threads; and a fixing collar having an end formed with external threads engageable with said internal threads of said adjusting ring and a longitudinal notch engageable with said slot of said connecting member.

* * * * *